United States Patent [19]

Kleefeldt

[11] 4,342,209

[45] Aug. 3, 1982

[54] CENTRAL VEHICLE DOOR-LOCK SYSTEM

[75] Inventor: Frank Kleefeldt, Heiligenhaus, Fed. Rep. of Germany

[73] Assignee: Kiekert GmbH & Co. Kommanditgesellschaft, Heiligenhaus, Fed. Rep. of Germany

[21] Appl. No.: 132,977

[22] Filed: Mar. 24, 1980

[30] Foreign Application Priority Data

Mar. 24, 1979 [DE] Fed. Rep. of Germany ..... 2911630

[51] Int. Cl.[3] ..... E05B 53/00

[52] U.S. Cl. ..... 70/264; 70/237; 70/280; 292/DIG. 3; 292/DIG. 23; 292/DIG. 25

[58] Field of Search ..... 70/262–264, 70/280, 283, 237, 256; 292/144, 201, DIG. 3, DIG. 14, DIG. 23, DIG. 25

[56] References Cited

U.S. PATENT DOCUMENTS 3,653,237 4/1972 DuRocher ..... 70/264
4,135,377 1/1979 Kleefeldt et al. ..... 70/264

FOREIGN PATENT DOCUMENTS 1177974 9/1964 Fed. Rep. of Germany ..... 70/263
1400006 7/1975 United Kingdom ..... 292/201
1461598 1/1977 United Kingdom ..... 292/201

*Primary Examiner*—William E. Lyddane
*Attorney, Agent, or Firm*—Karl F. Ross

[57] ABSTRACT

A central vehicle door-lock system has several door latches each including a detent movable between a lock position securing the door closed and an unlock position allowing the door to be opened by means of a mechanism inside the door latch. Each of these latches is associated with a servoactuator having an actuator that is engaged via this mechanism with the respective detent and that is in turn moved by an operator. This operator, therefore, can move the actuator and with it the latch detent between lock and unlock positions, and the operator itself is movable by a servomotor into an antitheft position. A lock pawl on the actuator can, in the lock position of the actuator and in the antitheft position of the operator, move from a freeing position permitting displacement of the actuator from the lock to the unlock position into a blocking position preventing such displacement to lock up the entire latch. The servomotors are all controlled by a central switdch which can operate them all jointly between the lock, unlock, and antitheft positions. Thus when the switch is in the antitheft position the mechanisms of the latches cannot displace the detents to the respective unlock positions.

10 Claims, 6 Drawing Figures

CENTRAL VEHICLE DOOR-LOCK SYSTEM

FIELD OF THE INVENTION

The present invention relates to a central vehicle door-lock system. More particularly this invention concerns such a system which allows all of the doors of a vehicle, including the hood and trunk doors, to be locked from a single location, normally the driver's door.

BACKGROUND OF THE INVENTION

It is known to provide a motor vehicle with a central door-lock system so that all of the doors, including the trunk and hood doors, can be locked and unlocked from a central location. Normally such a lock system is controlled from the latch for the driver's door so that by locking his or her door from the inside or outside the driver automatically locks all of the other doors of the vehicle. This system is particularly convenient in a large car where it would be fairly difficult for the driver to reach back and lock or unlock the back doors.

Normally a vehicle has door latches which each include a detent movable between a lock position securing the respective door to the respective doorpost and unlock position permitting separation of the respective door from the respective doorpost. Mechanism is provided for displacing this detent between the lock and unlock position. This mechanism includes inside and outside door handles, and an inside door button or lever and an outside door-lock cylinder. Usually the door handles are uncoupled by the mechanism from the detent when either the inside or outside door lock is operated. Nonetheless even if the door is locked from the outside it is normally possible to unlock it by raising the door button or lever on the inside. Thus it is also possible, even if the doors are locked, for a door to be opened by forcing the window to gain access to the inner door lock. It is further possible to slip a thin bar—a so-called "slim jim"—down into the door between the window and the outer door panel to operate the door mechanism and open up the door.

Typically in a central door-lock system each of the door latches is provided with a servoactuator basically formed as a reversible servomotor connected through appropriate link means to the respective door mechanism. This servoactuator is, therefore, connected in parallel normally to the inside door lock so that it can lock and unlock the door. All of these servomotors are in turn connected to a central switch that is normally incorporated with the inside and outside door locks of the driver's door. Thus when the driver locks or unlocks his or her door the other doors of the vehicle are automatically locked or unlocked. In this manner the driver is spared the effort of walking around the car to unlock or lock the passenger doors.

Such central lock systems, even though they are a considerable convience for the users, nonetheless in no way increase the security of the vehicle incorporating them. It is still just as possible for forced entry to be made of the vehicle in the manner described above.

OBJECTS OF THE INVENTION

It is, therefore, an object of the present invention to provide an improved central vehicle door-lock system.

Another object is to provide such a system which makes forced entry into the vehicle having it particularly difficult.

SUMMARY OF THE INVENTION

These objects are attained according to the instant instant invention in a central vehicle door-lock system of the above-described general type and wherein the servoactuators each include an actuator operatively engageable with the respective door-latch detent and displaceable between lock and unlock positions, an operator engageable with the actuator and engageable between lock, unlock, and antitheft positions, and a lock pawl displaceable by the respective operator only in the lock position of the respective actuator and in the antitheft position of the respective operator from a freeing position permitting displacement of the respective actuator from the respective lock to the respective unlock position into a blocking position preventing displacement of the respective actuator from the respective lock to the respective unlock position. Link means is provided connected between the detents, actuators, and operators for joint displacement of same between the lock and unlock positions. Each servoactuator has a servomotor connected to the operator for displacing same between the respective unlock, lock, and antitheft positions. Control means is connected to the servomotors and includes a switch displaceable between an unlock position for displacing the operators into the respective unlock positions, a lock position for displacing the operators into the respective lock positions, and an antitheft position for displacing the operator into the respective antitheft position. Thus when the switch is in the antitheft position the mechanisms of the door latches cannot displace the detents into the respective unlock positions, as the lock pawls are retaining the operators in the lock position to in turn retain the actuators and detents in the lock positions.

With such a system, therefore, even if the window of a vehicle is forceably opened, or one of the vehicle door locks is operated, the respective door cannot be opened because the respective servoactuator will be positively holding the respective door detent in the lock position. In a vehicle with inside door buttons, therefore, these buttons will be locked in the down or lock position so that the door cannot be opened. Of course in the lock position of the control switch any of the door latches can be operated by its respective inside or outside door lock.

According to further features of this invention the servomotor has a rotary output connected through stepdown gearing to a rack formed directly on a slide constituting the operator. The actuator is constituted as a slide and displaceable parallel to and adjacent the operator. This actuator is connected via a rod to a latch member of the mechanism of the door-latch mechanism. In its turn this latch member is displaceable between a coupling position in which it connects the inside and outside door handles to the detent, and a decoupling position in which actuation of the inside and outside door handles is not effective on the door detent. If course the inside and outside door locks are also connected to this latch member for displacing it between these coupling and decoupling positions.

According to this invention the operator has a bump or formation turned toward the actuator and engageable with an outwardly projecting depressible portion of the actuator. A spring urges this depressible portion outwardly with a force sufficient that when the formation of the operator engages this depressible portion it will longitudinally entrain the actuator until same is arrested at the end of its travel in the lock or unlock position. Further travel of the operator will merely depress the portion and allow the formation to move to the other side of it. Thus when the operator moves from the unlock through the lock to the antitheft position it pushes the actuator along by engagement of a formation on the depressible portion until the actuator reaches its end position in the lock position. Further displacement in this direction of the operator will depress the portion of the actuator so that the operator can continue to move on to the antitheft position.

According to another feature of this invention the pawl is pivoted on the actuator and has on one side a tooth engageable in a recess in the side of the housing and has another side engageable with the formation of the operator. This tooth can only engage in the recess of the housing in the lock position of the actuator. Thus when the operator moves into the antitheft position it will have already displaced the actuator into the lock position, and when it assumes the antitheft position it brings its formation into engagement with the other side of the pawl to displace it into the recess and thereby positively secure the actuator inside its housing. When moving from the antitheft to the unlock position the formation therefore first of all moves out of engagement with the pawl, then engages the underside of the depressible portion to move the actuator up into the unlock position.

According to this invention a spring is provided in the actuator biased against the pawl to urge it out of the recess. In addition this pawl is pivoted and weighted so that it normally would move out of this recess and a vector of force during motion from the lock to the unlock position is also effective on this pawl to move it out of the recess. Thus even if the spring fails the system will not remain locked up once the operator moves out of the antitheft position.

The door latch, which may be constructed in accordance with my copending application Ser. No. 132,978, filed Mar. 24, 1980, whose entire disclosure is herewith incorporated by reference, has a fork constituting the detent. The latch member in the uncoupling position not only prevents displacement of the detent form the lock to the unlock position by means of the inner or outer door handles, but it also actively blocks such displacement. Thus even if a relatively clever thief attempts to manipulate the mechanism inside the door, he or she will find the detent fork positively held in the lock position.

Thus in a system according to the instant invention it is possible in a relatively simple manner to provide very effective antitheft protection for a motor vehicle. Normally all that is needed is an extra position either on the vehicle burglar-alarm switch or on the vehicle driver's door switch. Thus when the driver locks up his or her vehicle or turns on his or her alarm the door locks are all automatically secured in such a manner that forceable entry becomes extremely difficult. Nonetheless the door latches themselves can be of conventional construction and the servoactuator for the system is not rendered so very complicated that it is failure prone and adds considerably to the cost of the system.

SPECIFIC DESCRIPTION

Figure 1:
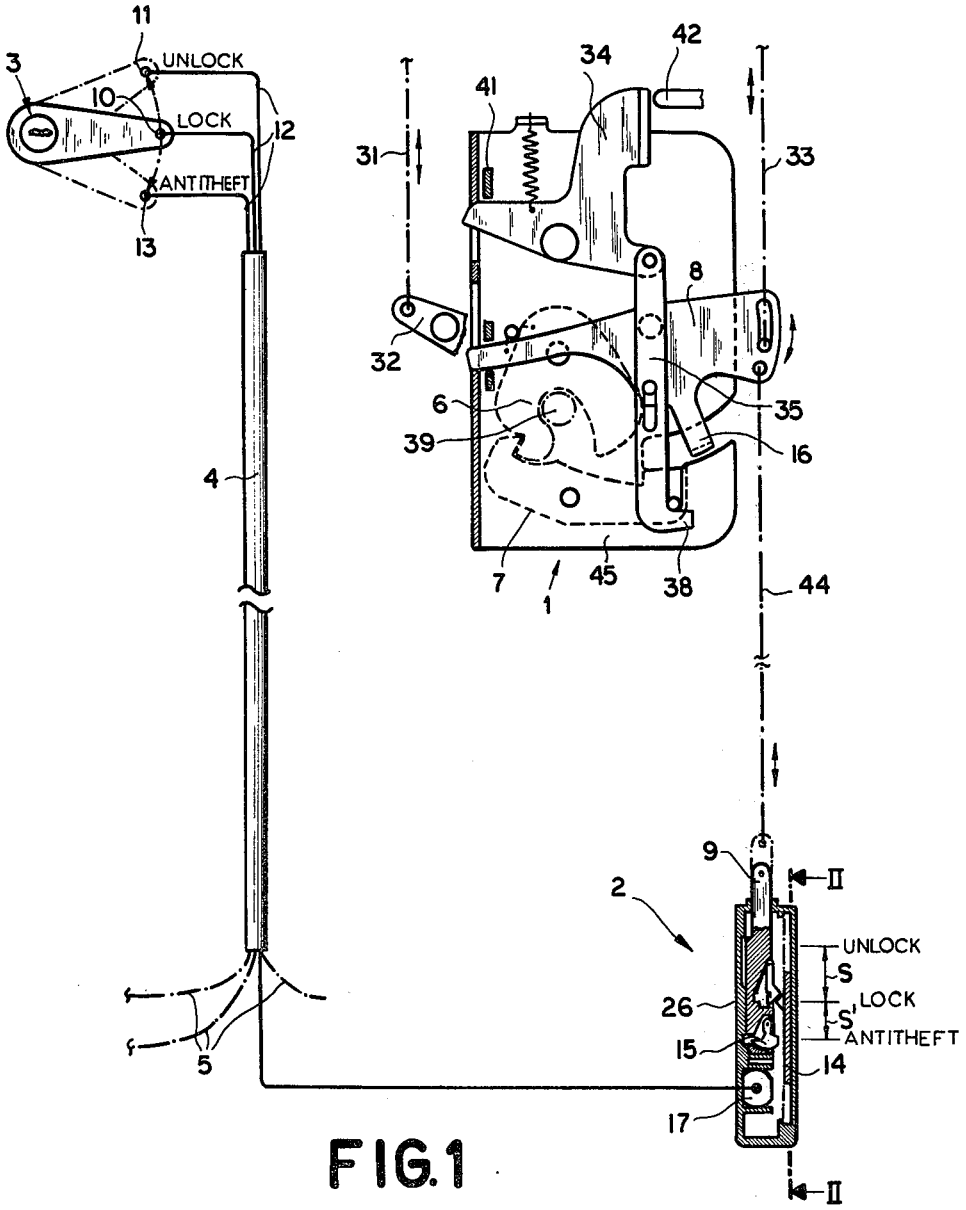
FIG. 1 is a small-scale partly schematic view of the central locking system according to the instant invention.
Figure 2:
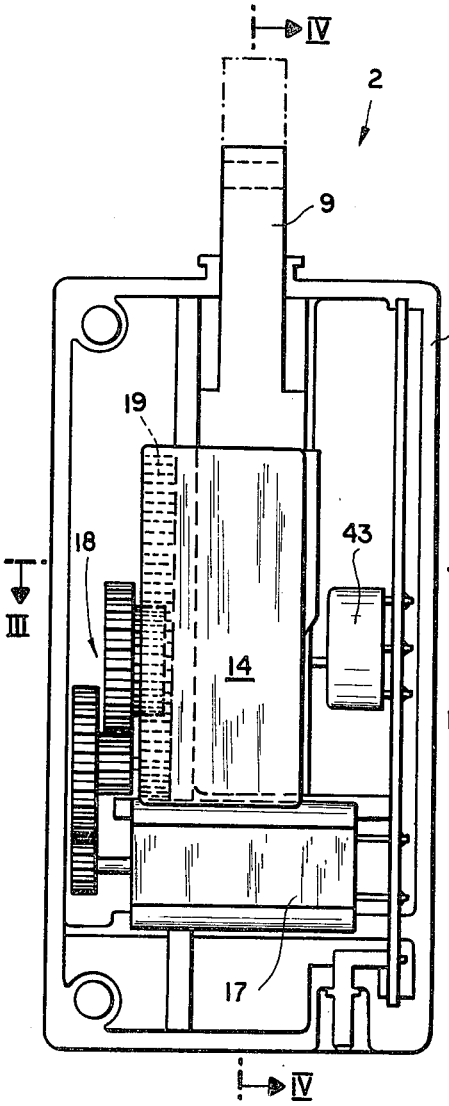
FIG. 2 is a large-scale section taken along the line II—II of FIG. 1.

As seen in FIG. 1 a central motor-vehicle lock system according to the instant invention is provided at each of its doors with a door latch 1 operable by a reversible servoactuator 2 operable in its turn by means of a key-operated switch 3 that may be incorporated in the door latch 1 for the front-seat driver's door. A cable 4 leads from the key-operated switch 3 and has a plurality of branches 5 each connected to a respective one of the door latches 1. In addition to having a latch 1 on each of the doors, it is possible to provide such latches for the trunk and hood also, it being within the skill in the art to eliminate mechanism unnecessary for locking the hood, trunk, or tailgate.

Each latch 1, which may be constituted also as described in my copending application Ser. No. 132,978 is mounted on the motor-vehicle door and has a standard detent fork 6 engageable with a bolt or pin 39 extending out of the respective doorpost. A pivotal locking pawl 7 in each latch 1 can retain the respective detent fork 6 in a position locking the respective bolt 39 in the latch 1, and can be retained in the illustrated locking position or moved out of it indirectly by a main latch member 8 connected via a link 44 to the servoactuator 2.

The switch 3 has a lock contact 10, an unlock contact 11, and an antitheft contact 13 connected to respective circuits or conductors 12 in the cable 4. It is possible, as mentioned above, for this switch merely to be integrated in the mechanical latch of the driver's door of the vehicle. Alternately it is possible to provide a separate switch, even operable by means of a separate key, for the contact 13 so that the device can only be placed in the antitheft position intentionally. In any case the switch is set up so that it can only be moved into the antitheft position by means of a key from outside the motor vehicle after intentionally locking its doors, so that the possibility of accidentally locking someone inside the vehicle is eliminated.

The servoactuator 2 basically has a slider 9 connected via the link 44 as described above with the main latch member 8. This slider 9 can in turn be displaced longitudinally inside the housing 26 of the servoactuator 2 by means of a slidable operator 14 shown best in FIGS. 2–5. This operator 14 is displaceable between offset lock, unlock, and antitheft positions, and is displaceable between a stroke S from the unlock to the lock position and through a stroke S' from the lock to the antitheft position, as determined by the position of the switch 3. More particularly the slidable operator 14 has a projection 24 engageable with a pivotal lever 22 on the slider 9. This lever 22 is received in a recess 20 in the slider 9 and is urged outwardly toward the projection 24 by means of a relatively stiff compression spring 21. The force exerted by the compression spring 21 is sufficient that longitudinal vertical displacement of the slidable operator 14 can entrain the slider 9 through the stroke S between the lock and unlock positions. These lock and unlock positions do, however, constitute solid end positions for displacement of the slider 9, so that if the slide operator 14 tries to move the slider further the lever 22 will be depressed and slide operator 14 will be able to move its projection 24 past the lever 22.

Figure 4:
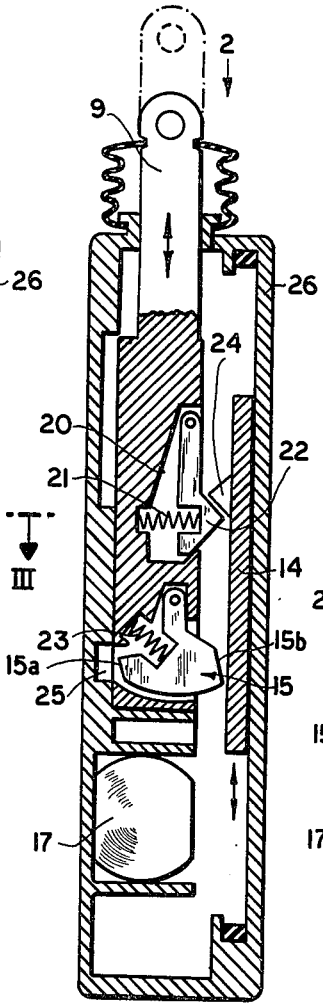
FIGS. 3 and 4 are sections taken respectively along lines III—III and IV—IV of FIG. 1.
Figure 5:
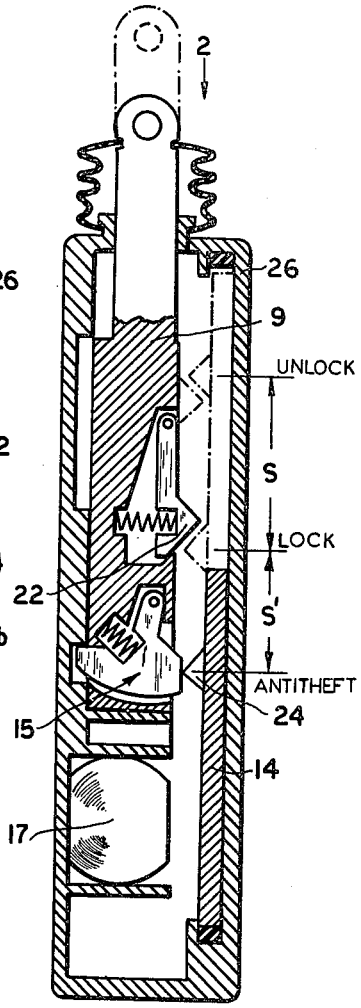
FIG. 5 is a view similar to FIG. 4 showing the system in another position.
Figure 3:
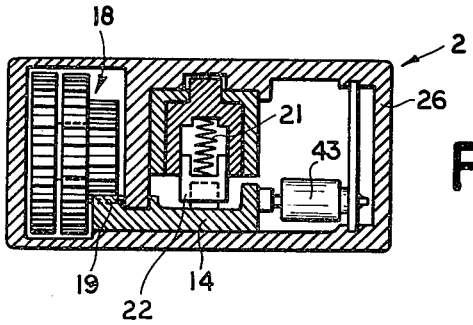

In addition the slider 9 is provided with a pivotal locking pawl 15 that has one side turned toward the slidable operator 14 and that is biased toward this operator 14 by means of a spring 23. In fact the pivot for the pawl 15 is provided above its center and the pawl 15 is so constructed that even absent the spring 23 it would naturally pivot counterclockwise as seen in FIGS. 4 and 5 toward the operator 14. This pawl 15 also has a tooth 15*a* engageable in a recess 25 formed in the housing 26. When the slide 9 is in the lower lock position, the projection 22 can engage the face 15*b* of the pawl 15 and press the tooth 15*a* into the recess 25, thereby rigidly locking the slide 9 against longitudinal vertical movement in the housing 26. Obviously such locking effectively prevents the member 8 of the latch 1 from moving, as the link 44 between this member 8 and the slide 9 is normally constituted by a rigid rod.

The slide operator 14 itself is displaced by a motor 17 connected to a stepdown gear train 18 that meshes with a rack 19 formed on the slide operator 14. This type of gear drive is effectively a one-way coupling, so that if the motor 17 is not energized the slide operator 14 cannot move. In addition a switch 43 provided inside the housing 26 is operated in the lock and antitheft positions of the slide operator 14 and is connected to appropriate warning indicators and the like for the vehicle driver.

Figure 6:
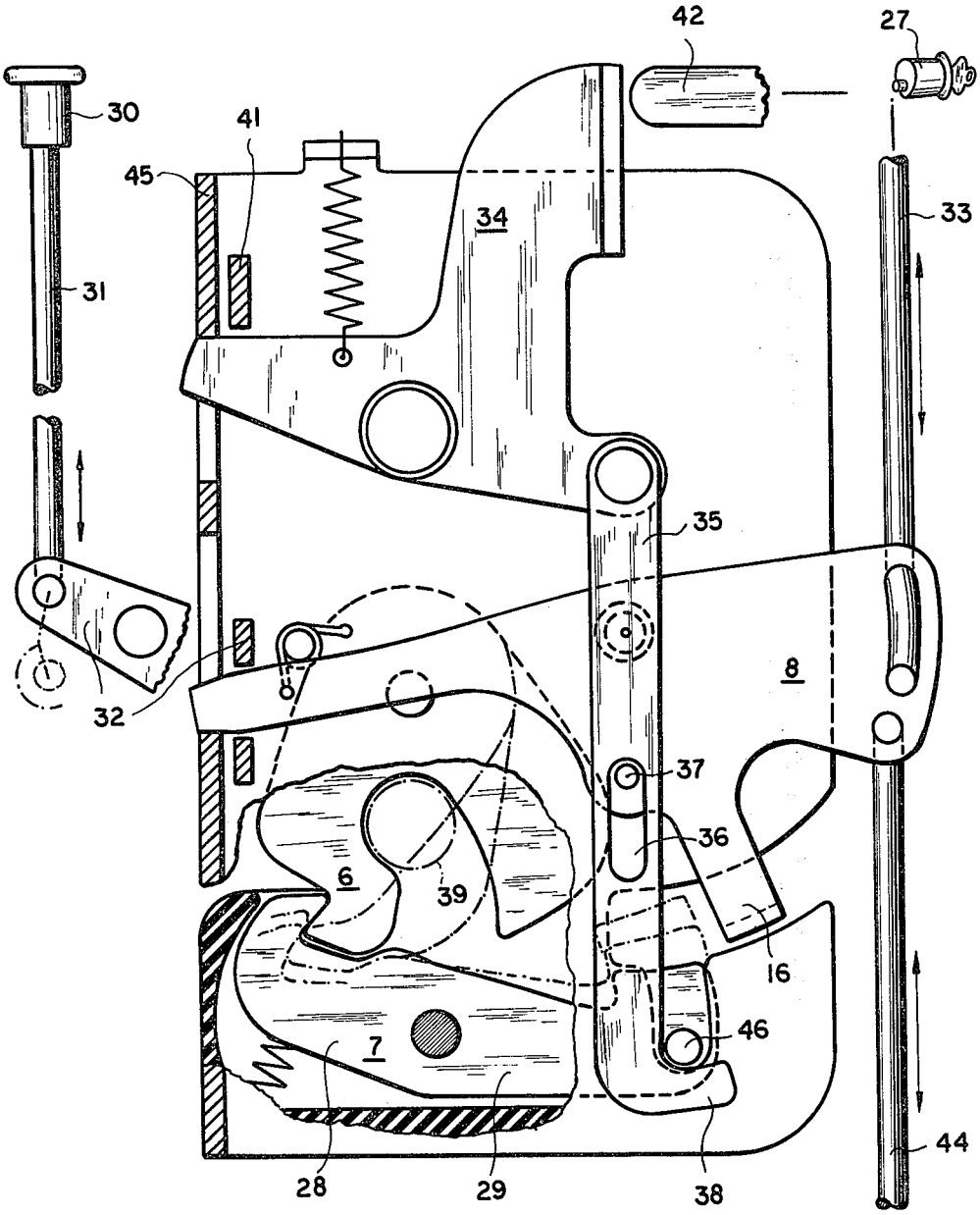
FIG. 6 is a large-scale view of a detail of the system of FIG. 1.

FIG. 6 shows how each latch 1 has a housing 45 in which the actuator 8, fork 6, and locking pawl 7 are pivotally mounted. The latch pawl 7 has one arm 28 formed as a hook engageable with the detent fork 6 and another arm 29 carrying a pin 46 normally engaged by a hook 38 formed at one end of an operating element 35 formed centrally with a slot 36 through which engages a pin 37 fixed on the actuator 8. In addition this actuator 8 has an arm 16 engageable with the arm 29 to prevent pivoting of the latch pawl 7 out of the solid-line locking position of FIG. 6 as will be explained in greater detail below. The latch 1 is operated to release the bolt 39 by lifting of the arm 29 by means of the member 35. This member 35 is therefore connected to a pivotal operating member 34 engageable by a pusher 42 that is carried on the outside door handle. Another lever 41 connected to the inside door handle can also act on this member 34 to raise the member 35 and thereby lift the arm 29 by interengagement of the hook 38 and the pin 46.

In order to prevent the door from being unlocked from either the inside or the outside the member 35 is swung to the left in FIG. 1 about its pivot on the member 34 so that its hook 38 is disengaged from the pin 46. This is achieved by clockwise pivoting of the member 8 from the illustrated position so as simultaneously to push the lower portion of the member 35 to the left as seen in FIG. 6 and to bring the arm 16 into alignment with the arm 29 to prevent pivoting of the pawl 7 in a direction allowing opening of the latch. Such pivoting of the member 8 can be effected from an inside door-lock button 30 through a rod 31 and lever 32. It can also be effected by means of a rod 33 extending from a cylinder 27 on the outside of the door. Finally, the link 44 as mentioned above is connected to this member 8 and displaces it downwardly into the locked position when the slide 9 moves down into its lock position.

Thus with the system according to the instant invention a central locking system can be set up so that not only can it lock all of the doors, including the tailgate, trunk, and hood of a motor vehicle, but it can also have a third position in which breaking-into the motor vehicle becomes almost impossible. In this third position even if a side window, for example, is smashed so that the would-be entrant can gain access to the inside door button 30, it will be impossible for him or her to raise this button 30 to pivot the member 8, as this member 8 will be rigidly held in the lock position by the slider 9. The slider 9 in turn is rigidly locked in place in the antitheft position by engagement of the tooth 15*a* in the recess 25, so that upward force on this slider 9 will merely be translated into opposite outwardly effective forces on the housing 26 which can easily be dimensioned to withstand these forces. If a separate key switch is provided for operation of the contact 13, even a person with a car-door key will not be able to open the vehicle. In such an arrangement this antitheft contact 13 can normally be integrated in a burglar alarm for the motor vehicle, so that not only will the would be entrant have to deal with a noisy burglar alarm, but the would-be entrant would find it extraordinarily difficult even to get into the car, even assuming he or she is willing to risk the noise of the burglar alarm.

The system is so set up that in the event the spring 23 fails the pawl 15 will not be able to lock the respective latch 1 closed. Thus if the spring 23 is broken, and even assuming that the pawl 15 gets stuck, once the projection 24 moves out of engagement with its face 15*b* any upward force exerted on the slider 9 will have a small component effective to pivot this pawl 15 counterclockwise and move its tooth 15*a* out of the recess 25. Thus the standard fear of any person who buys a motor vehicle incorporating a complex system such as the instant central locking system, will be largely overcome in that failure of a critical part will not prevent operation of the respective latch in the event that it fails.

I claim:

1. A central vehicle door-lock system comprising:

at least two door latches each including a detent movable between a lock position securing the respective door to the respective doorpost and an unlock position permitting separation of the respective door from the respective doorpost, and mechanism for displacing said detent between said lock and unlock positions;

respective servoactuators each including an actuator operatively engaged via said mechanism with the respective detent and displaceable between respective lock and unlock positions, an operator engageable with said actuator and displaceable between respective lock, unlock, and antitheft positions, a servomotor connected to said operator for displacing same between the respective unlock, lock, and antitheft positions, link means connected between said detents, actuators, and operators for joint displacement of same between the respective lock and unlock positions, and a lock pawl displaceable by the respective operator only in the lock position of the respective actuator and in the antitheft position of the respective operator from a freeing position permitting displacement of the respective actuator from the respective lock to the respective unlock position into a blocking position preventing displacement of the respective actuator from the respective lock to the respective unlock position; and control means connected to said servomotors and including a switch displaceable between a respective unlock position for displacing said operators into the respective unlock positions, a respective lock position for displacing said operators into the respective lock positions, and a respective antitheft position for displacing said operators into the respective antitheft positions, whereby when said switch is in said antitheft position said mechanisms cannot displace said detents into the respective unlock positions.

2. The system defined in claim 1 wherein each of said servoactuators has a housing containing the respective actuator, operator, and servomotor, and formed with an internally open recess, each of said pawls being pivotally mounted on the respective actuator and being engageable in the lock position of same in the respective recess.

3. The system defined in claim 2 wherein each of said actuators, when urged to move from the respective lock to the respective unlock position, creates a moment of force effective on said pawl in a direction urging it out of said recess.

4. The system defined in claim 2 wherein the actuator and operator of each servoactuator are both slidable in the respective housing next to each other, said pawls each having a side turned away from the respective recess and engageable by the respective operator in the respective antitheft position.

5. The system defind in claim 4 wherein said operators each have a formation engageable with the side of the respective pawl only in the respective antitheft position.

6. The system defined in claim 5 wherein each of said actuators has a depressable portion turned toward the respective operator and engageable by the respective formation and biasing means for urging the respective depressable portion outwardly with sufficient force for the respective operator to entrain said actuator on displacement between the respective lock and unlock positions, each of said depressable portions being depressable on displacement of the respective operator from the respective lock to the respective anti-theft position.

7. The system defind in claim 1 wherein said link means includes a rigid link rod extending between each of said actuators and the respective latch mechanism.

8. The system defined in claim 1 wherein each of said detents is a locking fork and each of said mechanisms includes a latch member displaceable between a coupling position engaged between the respective actuator and the respective fork and an uncoupling position disengaged from between the respective actuator and the resptive fork.

9. The system defined in claim 8 wherein each of said latches further includes:

a lock element coupled to the respective latch member for displacing same between said coupling and decoupling postions; and a door handle coupled to the respective latch member and couplable therethrough to the respective detent for displacing same between the respective lock and unlock postions.

10. The system defined in claim 9 wherein each of said latch members has a formation engageable in the respective decoupling position for preventing displacement of the respective detent out of the respective lock position.

* * * * *